United States Patent [19]

Lamberty et al.

[11] 4,243,993

[45] Jan. 6, 1981

[54] BROADBAND CENTER-FED SPIRAL ANTENNA

[75] Inventors: Bernard J. Lamberty; George S. Andrews, both of Kent, Wash.

[73] Assignee: The Boeing Company, Seattle, Wash.

[21] Appl. No.: 93,183

[22] Filed: Nov. 13, 1979

[51] Int. Cl.[3] ..... H01Q 1/36

[52] U.S. Cl. ..... 343/895

[58] Field of Search ..... 343/802, 895, 908

[56] References Cited

U.S. PATENT DOCUMENTS

| | | | |
|---|---|---|---|
| 3,229,293 | 1/1966 | Little et al. | 343/895 |
| 3,344,425 | 9/1967 | Webb | 343/895 |
| 3,381,297 | 4/1968 | Zisler | 343/895 |
| 3,454,951 | 7/1969 | Patterson et al. | 343/895 |
| 3,465,346 | 9/1969 | Patterson et al. | 343/895 |
| 3,562,756 | 2/1971 | Kuo et al. | 343/895 |
| 3,633,210 | 1/1972 | Westerman et al. | 343/895 |
| 3,641,579 | 2/1972 | Voronoff | 343/895 |
| 3,681,772 | 7/1972 | Ingerson | 343/895 |
| 3,787,871 | 1/1974 | Reese | 343/895 |
| 3,949,407 | 4/1976 | Jagdmann et al. | 343/895 |
| 3,956,752 | 5/1976 | Phelan et al. | 343/895 |
| 3,969,732 | 7/1976 | Holloway | 343/895 |
| 3,995,277 | 11/1976 | Olyphant | 343/700 MS |
| 4,087,821 | 5/1978 | Phelan | 343/895 |

*Primary Examiner*—Eli Lieberman

*Attorney, Agent, or Firm*—Christensen, O'Connor, Johnson & Kindness

[57] ABSTRACT

Spiral antennas are disclosed wherein each antenna arm includes one or more choke elements that resonate at predetermined operating frequencies to eliminate or minimize undesired radiation and reception characteristics. Multi-arm arrangements for broadband applications requiring sum and difference mode operation with both right-hand and left-hand circularly polarized radiation characteristics are attained by including a plurality of selectively positioned and dimensioned choke elements in each antenna arm. A variety of transmission line sections, suitable for use as choke elements in several types of spiral antennas, is described.

28 Claims, 15 Drawing Figures

Fig. 5A.
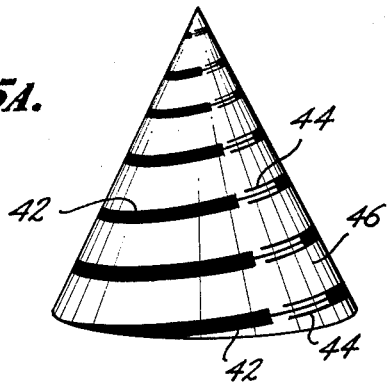
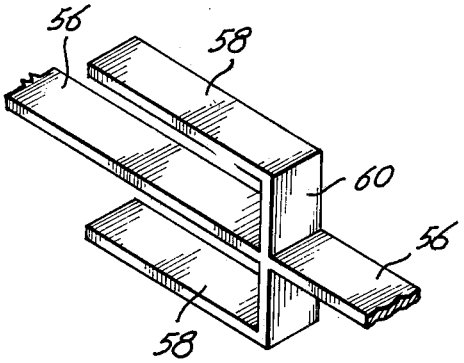
Fig. 6A.
Fig. 5B.
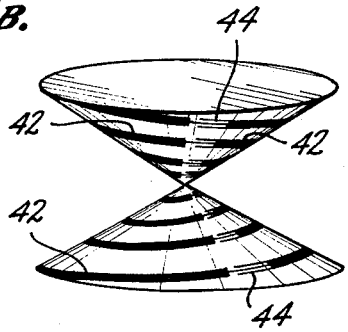
Fig. 5C.
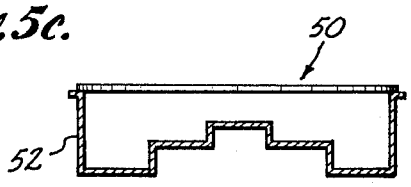
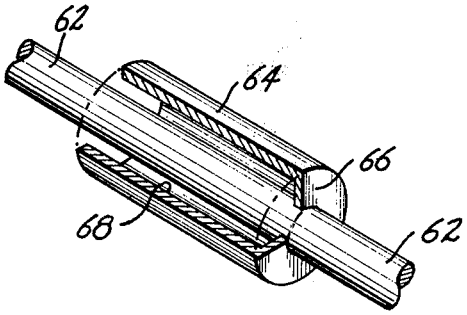
Fig. 6B.
Fig. 5D.
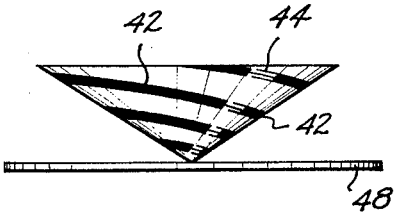

BROADBAND CENTER-FED SPIRAL ANTENNA

BACKGROUND OF THE INVENTION

This invention relates to spiral antennas and more particularly to center-fed multi-arm spiral antennas that are configured for transmitting both right and left-hand circularly polarized electromagnetic fields over a broadband of frequencies and/or receiving electromagnetic radiation of any polarization sense over a similarly wide frequency range.

It is well known in the art that center-fed multi-arm spiral antennas can be utilized to produce circularly polarized electromagnetic radiation with center-fed spiral antennas that are wound in the counterclockwise direction exhibiting right-hand circular polarization and antennas that are wound in the clockwise direction exhibiting left-hand circular polarization. Further, it is known that a center-fed multi-arm spiral antenna having N-arms or elements is capable of $N-1$ independent modes of operation by suitably establishing the phase difference between the excitation currents. In this regard, a first mode of operation (of mode order $M=1$) is attained when the phase difference between adjacent arms of the antenna is $2\pi/N$. The $M=1$ mode is commonly referred to as the sum (or $\Sigma$) mode and produces a single-lobed radiation pattern that exhibits maximum field strength along, and symmetric about, the antenna boresight axis. Higher order modes (i.e., $M=2,3,\ldots,N-1$), often called the difference (or $\Delta$) modes, are obtained by feeding the antenna such that the phase difference between adjacent arms is $2\pi M/N$ and produce a radiation pattern that exhibits a null along the antenna boresight axis and maximum field strength along a cone of revolution about the boresight axis. In this respect, as the mode number increases a larger cone angle is exhibited between the imaginary line of maximum field strength and the antenna boresight axis and a decrease in relative field strength is exhibited.

An additional known characteristic of spiral antennas is that the radiation is emitted from substantially annular regions of the antenna in which the currents flowing through the adjacent arms are substantially in phase with one another. Because of the phase difference between the excitation currents and the spacial separation of the feed points this means that the radius at which maximum radiation occurs decreases as a function of frequency and increases as a function of the mode number M. For example, in a planar, tightly wound logarithmic spiral antenna, maximum radiation is often considered to occur at a radial distance of approximately $M\lambda/2\pi$ from the center of the antenna where $\lambda$ denotes the freespace wavelength of the radiated signal.

In some situations a spiral antenna is utilized for transmitting or receiving sum mode radiation of a single polarization sense. In such a case, either a 2-arm spiral antenna or a single-arm arrangement in which the antenna arm is spaced apart from a ground plane can be employed. When such an antenna is to operate over a substantial frequency range, each antenna arm is dimensioned to accommodate the lowest frequency of interest and since radiation efficiency of 100 percent is not achieved, a portion of each arm current is not radiated within the previously mentioned annular region of the antenna, but continue to flow outwardly. If the associated antenna arm is of sufficient length, these residual currents reach secondary radiation regions in which an inphase relationship is attained and additional sum mode radiation of the intended polarization sense is emitted. Since such secondary radiation zones are spatially separated from the intended radiation zone antenna pattern degradation may result. Additionally, if the equivalent electrical length of the antenna arm is less than that required to produce secondary radiation, the residual arm current will be reflected from the outer terminus of the antenna arm and flow inwardly toward the antenna feed point. As described relative to the converted mode antenna arranges discussed in the following paragraphs, these inwardly flowing currents can cause radiation of a signal of the opposite polarization sense. When the antenna is intended to produce sum mode radiation of a particular polarization sense, producing an oppositely polarized radiation component may be an undesirable characteristic.

In addition to situations that require the transmission or reception of sum mode radiation of a particular polarization sense, there are many situations in which it is desired or necessary to transmit both left-hand and right-hand polarized signals or receive signals regardless of the polarization of the incident electromagnetic energy. Accordingly, several attempts have been made to adapt spiral antennas for such operation. For example, it has been recognized that a spiral antenna that is wound in a particular direction (clockwise or counterclockwise) exhibits a specific sense of circular polarization (right-hand of left-hand) when center-fed and the opposite sense of polarization when fed from the outer ends of the antenna arms. In this regard, the feed current phase relationship that causes operation in the "ith" mode (i.e., $M=i$; $i=1,2,\ldots,(N-1)$ when center-fed at the inner terminals produces radiation of the opposite polarization sense in the $(N-i)$ th mode (i.e., $M=N-i$; $i=1,2,\ldots,(N-1)$ when the feed currents are applied to the outer ends of the antenna arms.

Although spiral antennas which provide operation with both left-hand and right-hand circular polarization by utilizing the inner and outer terminations of each antenna arm as signal terminals are satisfactory in some situations, several disadvantages and drawbacks are encountered. The primary limitation is that such configurations can only operate over a relatively narrow bandwidth (i.e., less than an octave). Additionally, as compared to a center-fed arrangement, twice as many signal terminals are required and configuring the antenna so that the impedance of the outer feed points is substantially identical to the impedance exhibited by the centrally located feed points can present problems.

A second technique that has been employed to configure spiral antennas for operation with both right-hand and left-hand circular polarization utilizes a spiral antenna having only the inner (or, alternatively the outer) terminations of the antenna arms connected to the associated transmitting or receiving system wherein higher excitation modes are, in effect, converted to lower operating modes of the opposite polarization sense. Spiral antennas utilizing this technique are typified by the antenna structure disclosed in Kuo et al, U.S. Pat. No. 3,562,756 and Ingerson, U.S. Pat. No. 3,681,772.

In accordance with the teachings of the Kuo et al patent, a multi-arm, center-fed spiral antenna is configured such that the length of the antenna arms and hence the radius of the antenna is less than that required to emit radiation at one or more of the higher operating modes. Considering such an arrangement from the standpoint of a transmitting antenna, this means that when excitation currents that would normally produce a higher mode of radiation are applied to the antenna terminals, the currents travel outwardly through the antenna arms and are reflected from the terminations thereof to flow inwardly toward the center of the antenna. Thus, center-fed currents at the higher excitation modes are, in effect, converted to inwardly flowing currents which produce radiation having a sense of polarization opposite to the radiation produced by the outwardly flowing currents that are induced when the antenna is excited at one of the lower modes. Since little signal attenuation occurs and since the phase relationship of the reflected arm currents is identical to that necessary to produce a lower mode of operation with the opposite sense of polarization, a N-arm spiral antenna configured in this manner can supply $(N-1)/2$ modes of both polarization senses (right-hand and left-hand) when N is an odd integer and $(N-2)/2$ modes of both polarization senses when N is even. For example, one arrangement disclosed in the Kuo et al. patent utilizes a planar spiral antenna having six elements that are wound in the counterclockwise direction in a manner which would normally produce right-hand circularly polarized radiation at operating modes $M=4$ and $M=5$ within regions of the antenna having a circumference greater than 2.75 $\lambda$ (i.e., a radius greater than 1.375 $\lambda/\pi$), where $\lambda$ is the freespace wavelength of the transmitted signal. To effect the discussed converted mode operation, the antenna arms are terminated so that the circumference of the antenna is 2.75 $\lambda$. Thus, exciting the antenna so that the phase difference between adjacent arms is $5\pi/3$ radians (300° ) does not produce right-hand circularly polarized radiation at $M=5$ (the fourth difference mode) but produces left-hand circularly polarized radiation at $M=1$ (the sum mode). Similarly, center feeding the antenna so that the phase difference between adjacent arms is $4\pi/3$ radians (240° ) does not result in right-hand circularly polarized radiation in the $M=4$ mode, but results in left-hand circularly polarized radiation in the $M=2$ mode (the first difference mode). Thus, simultaneously or selectively supplying feed currents to the center terminals of this antenna which would normally produce right-hand circularly polarized radiation at $M=1$, $M=2$, $M=4$ and $M=5$, produces sum and difference modes ($M=1$ and $M=2$ modes) of both right-hand and left-hand circular polarization sense.

The primary disadvantage of achieving converted mode operation by terminating the antenna arms in the manner taught by the Kuo et al patent is that such antennas are only suitable for use over a relatively narrow frequency range. In this regard, the circumference of such an antenna must be equal to or greater than that required to emit radiation in the normal manner at the desired lower modes of operation when the antenna is excited at the lowest frequency of operation and must be less than or equal to the circumference at which radiation of the higher, converted operating modes would normally occur when the antenna is excited at the highest frequency of interest. Because of these conflicting constraints, even such an antenna that includes eight elements and is arranged to supply sum and first difference mode radiation with both left-hand and right-hand polarization is restricted to operation over a bandwidth of one octave or less.

The above-referenced patent to Ingerson discloses spiral antenna arrangements in which signal reflection and, hence, converted mode operation is attained by controlling the effective electrical length of each antenna arm rather than by physically terminating the antenna arms. In the disclosed arrangement, identified as a modulated arm width (MAW) spiral antenna, each antenna arm comprises a series of "cells" formed by a section of antenna arm having a first, relatively narrow width dimension followed by a section of antenna arm of substantially greater width dimension. These cells or "modulations" are positioned along the antenna arms to establish impedance discontinuities or reflection regions (denoted as "stopbands" in the Ingerson patent) which are intended to selectively reflect the outwardly flowing currents. In particular, since maximum signal reflection occurs when the length of a cell corresponds to $\gamma/2$, utilizing a plurality of modulations in each antenna arm with cell length increasing as a function of the distance between the center of the antenna and the location of a particular cell, in effect, causes each arm to exhibit an effective electrical length that is inversely proportional to the frequency of the excitation signal. Thus, by also establishing the position of the arm width modulations (cells) so that currents produced by selected higher modes of excitation are reflected whereas the lower modes produce radiation in the conventional manner, operation is achieved with both left-hand and right-hand circular polarization. As is the case with other center-fed spiral antennas that utilize converted mode techniques, currents that would normally establish radiation at one of the higher modes $M=i$ establishes radiation of the opposite polarization sense at an operating mode $M=N-i$ and at least $2M_m+1$ antenna arms are required to effect both right-hand and left-hand polarization at modes $M=1, 2, \ldots, M_m$.

Although modulated arm width spiral antennas of the type disclosed in the Ingerson patent are operable over a frequency range that substantially exceeds the bandwidth of previously proposed converted mode spiral antennas (e.g., those disclosed in the Kuo et al patent), substantial problems and drawbacks are still encountered. In particular, the stopbands do not provide substantially total reflection of the excitation currents that are to be converted into lower mode radiation of the opposite polarization sense and a significant portion of the antenna current continues to flow outwardly through the antenna arms. When the circumference of such an antenna is established for operation over a substantial bandwidth, most of the currents that pass beyond the stopbands cause higher mode order radiation with a polarization sense opposite to that of the desired converted mode radiation. Since the currents intended to induce converted mode operation are not totally reflected, the relative field strength of each converted mode differs from that of the corresponding lower mode of operation in which no signal reflection is induced. Further, the undesired radiation at the higher order modes may cause asymmetry of the radiation patterns relative to the antenna boresight axis. Thus, the characteristics of a modulated arm width antenna are both frequency and polarization dependent. Moreover, modulated arm width antennas are subject to inherent geometric constraints that can make it difficult to attain the desired electrical characteristics. In this respect, the conductor width required to achieve the desired modulation may conflict with the desired wrap angle (curvature of the antenna arms) and the requirement that length of each cell be $\pi/2$ may not permit each antenna arm to include as many cells as are necessary to effect uniform performance relative to variations in frequency.

In many applications the above-discussed non-ideal performance of a modulated arm width spiral antenna either causes substantial compromises in system performance and/or requires utilization of relatively complex compensating circuits. For example, amplitude monopulse tracking systems or angle of arrival systems that are independent of received signal polarization and continuously operable over a multi-octave frequency band require an antenna having radiation patterns that are highly symmetric about the antenna axis and independent of both frequency and polarization sense. In this regard, such systems detect the angle of arrival of an incident signal by determining the ratio between the signal induced at the difference mode and the signal induced at the sum mode of like polarization sense. In particular, the amplitude of the detected ratio corresponds to a "cone angle" that defines a cone of revolution about the antenna boresight axis which contains a line between the antenna and the source of radiation and the relative phase angle of the ratio corresponds to a "clock angle" which indicates the element along the surface of the cone of revolution that corresponds to the line between the antenna and source of radiation. To maintain proper relationship between the magnitude of the difference mode/sum mode radio ($\Delta/\Sigma$) and ensure that the phase of the ratio varies linearly with clock angle, the radiation pattern of each sum and difference mode must exhibit virtually complete symmetry about the antenna boresight axis. Further, to permit the accuracy of such a system to be independent of received signal polarization, the two sum mode radiation patterns and the two difference mode radiation patterns must be of identical geometry.

Accordingly, it is an object of this invention to provide a broadband spiral antenna which includes means for controlling and reflecting the induced arm currents in a manner that reduces or eliminates undesired radiation characteristics such as secondary radiation.

It is another object of this invention to provide an improved broadband spiral antenna that is configured for operation with both left-hand and right-hand and circularly polarized radiation fields.

It is yet another and related object of this invention to provide a N−arm center-fed spiral antenna in which excitation currents that would normally result in radiation at a selected set of mode orders (N−1), (N−2), . . . (N−M) undergo substantially total reflection to produce radiation corresponding to the opposite sense of polarization at mode orders 1, 2, . . . , M.

It is still another object of this invention to provide a multi-arm spiral antenna which exhibits substantially identical characteristics relative to radiation of both left-hand and right-hand circular polarization to thereby provide an antenna suitable for use with high accuracy angle of arrival and amplitude monopulse tracking systems.

SUMMARY OF THE INVENTION

These and other objects are achieved in accordance with this invention by a center-fed spiral antenna which includes choke elements that are spaced along the antenna arms to selectively reflect the currents induced therein and effect the desired radiation characteristics in the disclosed embodiments of the invention, the choke elements are integrably formed in the relatively flat, ribbon-like conductors that comprise the antenna elements or arms. Each choke element is positioned so as to lie outwardly of the antenna regions which radiate one or more desired lower modes of radiation and is dimensioned and arranged for substantially total reflection of a particular frequency antenna current to cause converted mode operation at one or more predetermined high-order excitation modes. Thus, considered in terms of its transmitting characteristics, an antenna configured in accordance with this invention can be arranged to produce a selected number of independent normal operating modes of one polarization sense (right-hand or left-hand circular polarization) and a selected number of converted operating modes of the opposite polarization sense. For example, in one disclosed embodiment that is suitable for use in high accuracy angle of arrival and amplitude monopulse systems, an antenna having six arms is utilized to provide right-hand circularly polarized sum mode and difference mode radiation characteristics when selectively or simultaneously fed so that the phase difference between components of excitation currents of adjacent antenna arms is 60° and 120° and provide left-hand circularly polarized sum and difference mode radiation characteristics when components of the current fed to adjacent antenna arms is 300° and 240°, respectively.

In accordance with the invention, various conductor geometry can be utilized to realize the choke elements of the invention with the geometry of the chokes and various other design parameters being selected and adjusted to optimize antenna performance relative to a desired bandwidth. For example, in the disclosed embodiments in which the antenna arms are formed by relatively flat conductive elements, each choke element is essentially a section of microstrip transmission line having a centrally located conductive region which, in conjunction with the adjoining sections of antenna arms, forms a continuous current path. In these arrangements, two or more conductive strips are electrically interconnected with the central conductive region and extend in parallel, spaced-apart juxtaposition therewith to form resonant structure which, in effect, terminates the associated antenna arm in an open circuit when the length of the choke element substantially corresponds to one-fourth the freespace wavelength of the current flowing through that antenna arm. Thus, by including a plurality of choke elements in each antenna arm with the length of the choke elements increasing as a function of the distance between the center of the antenna and the position of a choke element, antennas configured in accordance with this invention can be arranged to exhibit a substantially constant electrical radius over a wide frequency range (eg., a frequency range of 100:1 or more). By way of example, in the previously mentioned embodiment that utilizes a six-element antenna to derive virtually identical sum and difference mode radiation characteristics of both right-hand and left-hand circular polarization, the innermost choke elements are sized to reflect signals at the uppermost frequency of interest and are positioned to lie outside of the antenna region which emits normal, center-fed sum and difference mode radiation (eg., right-hand circular polarization) while simultaneously lying inside of the region which would normally radiate energy at the higher operating modes (i.e., M=3, 4, 5). In a similar manner, the outermost choke element of each antenna arm is sized to reflect signals at the lowermost frequency of interest and is located near the outer terminus of the associated antenna arm to reflect currents which would otherwise induce radiation at undesired mode orders (M=3, 4 and 5). The remaining choke elements are positioned along each antenna arm with a spacing that is selected in view of various other design parameters such as the type of choke element being employed, the physical size of such choke elements and electrical characteristics of the choke element (eg., characteristic impedance and quality factor, Q).

Since the choke elements of each embodiment of the invention provide a greater degree of signal reflection than that obtainable in prior art broadband spiral antenna arrangements, antennas configured in accordance with this invention provide both right-hand and left-hand circularly polarized radiation wherein the field patterns of the corresponding operating modes are virtually identical in shape and relative field strength. Further, since a variety of choke configurations are available and the physical and electrical characteristics as well as the spacing between choke elements can be selected to optimize the antenna operating characteristics, the invention provides greater design flexibility than has previously been obtained. That is, since several design parameters determine the performance of an antenna of this invention, the designer is able to theoretically or empirically adjust the antenna configuration to achieve a desired radiation response that is relatively independent of frequency throughout the range of interest. Additionally, the disclosed choke elements permit an antenna topology which allows the rate or curvature of the spiral antenna arms (wrap) to be equivalent to that of conventional spiral antennas. For example, several of the disclosed choke elements exhibit a width dimension that is identical to that of the remaining portion of the antenna arms and, in one disclosed embodiment of the invention wherein the width of the choke elements exceeds the width of the remaining portion of the antenna arms, the choke elements are located and arranged so as to permit utilization of a relatively small radius of curvature.

BRIEF DESCRIPTION OF THE DRAWING

Other objects and advantages of the present invention will become apparent to one skilled in the art after reading of the following description taken together with the accompanying drawing, in which:

FIGS. 5*a* through 5*d* illustrate various antenna arrangements and arrays which can employ the antennas of this invention; and FIGS. 6*a* and 6*b* respectively illustrate choke elements that can satisfactorily be employed in embodiments of the invention wherein the conductive elements forming the antenna arms are of rectangular and circular cross-sectional geometry.

DETAILED DESCRIPTION

Figure 1:
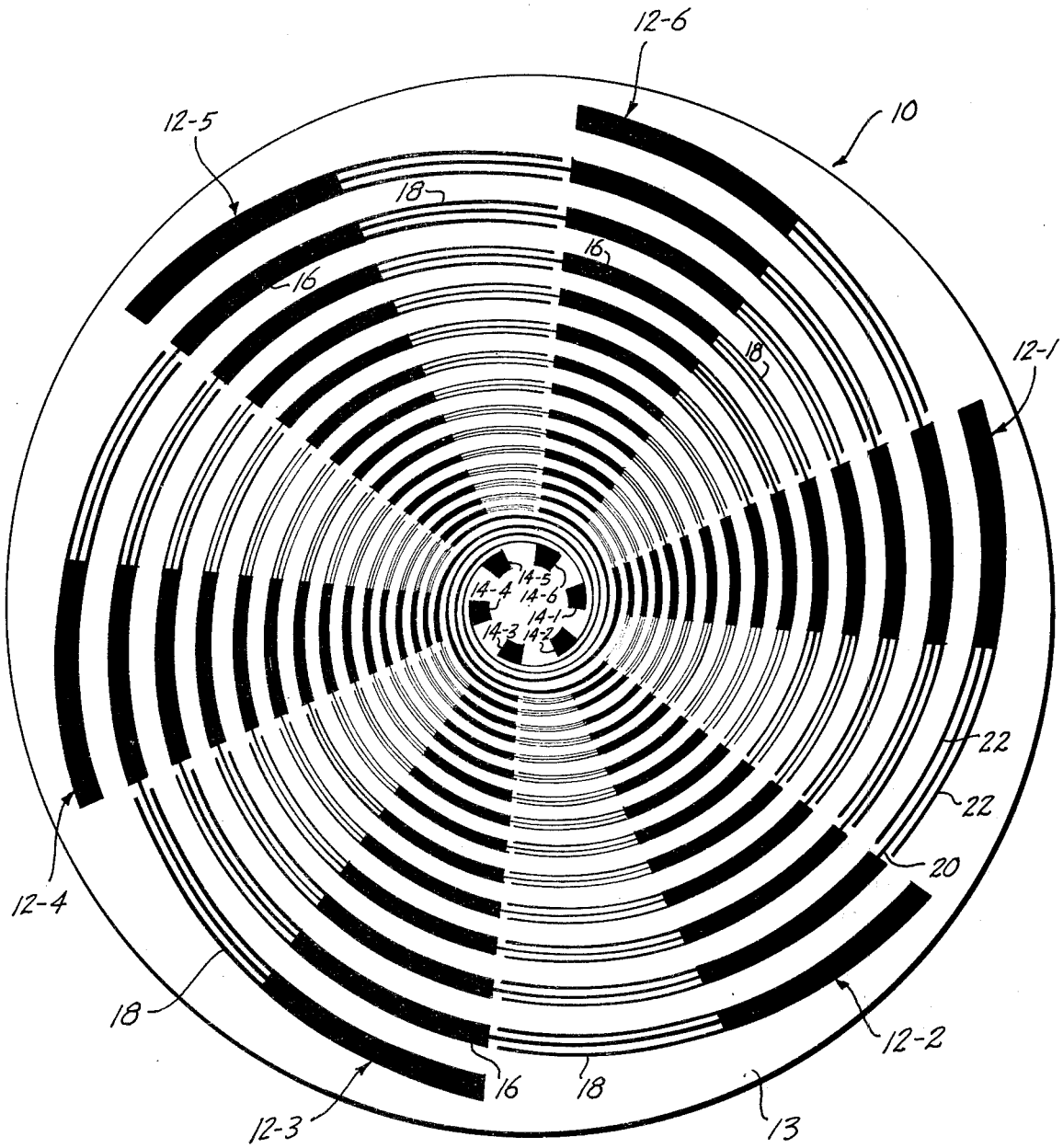
FIG. 1 depicts a multi-arm spiral antenna configured in accordance with this invention.

The embodiment of the invention which is depicted in FIG. 1 and generally denoted by the numeral 10 includes six conductive antenna elements or arms 12-1 through 12-6 that are supported on a dielectric substrate 13 and spiral outwardly in the counterclockwise direction from associated terminal regions 14-1 through 14-6. The terminals 14-1 through 14-6 are equally spaced apart from one another to form a circular pattern having a center that coincides with the center of the antenna 10 and provide for electrical interconnection of the antenna 10 with circuitry of various rf transmitting and/or receiving systems (not shown in FIG. 1). In accordance with known practices for constructing conventional spiral antennas, the antenna 10 can be formed from a metalclad dielectric substrate in the same manner as conventional printed circuit boards. Although other conventional fabrication techniques can be employed, photographic reproduction and etching processes the same as, or similar to, those used in manufacturing printed circuit boards provide a convenient method of achieving the desired dimensional tolerances and, by selecting either a rigid or flexible substrate material, various antenna configurations can be obtained (e.g., planar or conical).

In the embodiment of FIG. 1, antenna arms 12-1 through 12-6 are of identical length and include an innermost region in which each antenna arm is a continuous ribbon-like conductor so that the central region of the antenna 10, in effect, forms a small conventional spiral antenna. Outside of this central continuous conductor region, each antenna arm 12 is comprised of a number of ribbon-like solid conductor regions 16 and a like number of choke elements 18 that are alternatively interspersed with one another. The term "choke element" is utilized herein since the choke elements 18 of FIG. 1 and the various other choke elements described relative to FIGS. 2, 3 and 4 comprise one or more sections of short-circuited transmission line that are similar in structure to the choke or inductive elements utilized in the design of various high frequency circuit arrangements such as strip line filters. In terms of the present invention, the choke elements are connected in series with the antenna arms 12 and control the effective electrical length of the associated antenna arm as a function of frequency. More specifically, single choke elements such as choke elements 18 of FIG. 1 are resonant at a signal frequency wherein the length of the choke element is substantially equal to $\lambda/4$, where $\lambda$ is the wavelength of the signal current flowing within the antenna arm. Since parallel resonance is exhibited, each particular choke element 18, in effect, forms an open circuit at the associated resonant frequency to thereby reflect substantially all of the outwardly flowing currents at that particular frequency. By controlling the length and the positioning of the choke elements 18 in the manner described more fully hereinafter, radiation at undesired operating modes is suppressed over a relatively wide frequency band and converted mode operation is attained.

With continued reference to FIG. 1, the choke elements 18 depicted therein include an inner conductive strip 20 that extends between the midpoint of the spaced-apart terminal edges of two adjacent arm regions 16 with the inner conductive strip 20 having a radius of curvature that substantially corresponds to that of the associated antenna arm 12. Two outer conductive strips 22 extend from the outermost associated arm region 16, being concentrically spaced apart from the inner conductive strip 20. In the arrangement depicted in FIG. 1, the spacing between the inner conductive strips 20 and outer conductive strips 22 is substantially equal to the width of the inner and outer conductor strips 20 and 22. In this regard, the spacing between the conductive strips 20 and 22 as well as the basic configuration of the choke elements 18 are design parameters, which along with various other parameters discussed hereinafter, permit attainment and optimization of desired antenna characteristics.

Both the operation of the invention and various design techniques utilized in the practice of the invention can be understood by considering a realization of antenna 10 of FIG. 1 for use in an amplitude monopulse tracking or angle of arrival system which requires precise sum and difference mode radiation patterns of both right-hand and left-hand circular polarization. Although, for simplicity of description, this antenna and other embodiments of the invention discussed herein are considered primarily in terms of transmitting characteristics, it will be recognized by those skilled in the art that network reciprocity applies and, thus, the corresponding receiving characteristics are similar and fully determined.

In considering the six-element antenna 10 of FIG. 1 in a conventional manner, the five possible modes of excitation can be expressed as:

$$I_m = (0,\ M\ \pi/3,\ 2M\ \pi/3, M\ \pi,\ 4M\ \pi/3, 5M\ \pi/3)$$

where $M=1, 2, \ldots, 5$ denotes the order or mode number of the resulting radiated energy, the excitation current applied to terminal 14-1 is utilized as a reference, and the respective entries of $I_m$ respectively denote the relative phase angle between the feed current applied to terminals 14-2 through 14-6 relative to the feed current applied to terminal 14-1. As is known in the art, when a conventional six-element spiral antenna is fed with currents at one or more of the five possible excitation modes, currents flow outwardly through the antenna arms and little attenuation or radiation is exhibited until the currents of adjacent arms are substantially in phase with one another. When this occurs, a substantial portion of the energy is radiated and the antenna currents rapidly decay as a function of further increases in radial distance. As is known in the art, these zones of radiation or "active" regions correspond to annular portions of the antenna that are radially separated from the center of the antenna by a distance that is directly proportional to both the mode of operation (mode order $M_i=1, 2, \ldots, (N-1)$ and the freespace wavelength of the radiated signal. Although the location and width of each radiation region is actually a function of various parameters such as the number of antenna arms and the "tightness" or wrap angle of the spiral, the radiation region associated with each mode $M_i$ is commonly considered to occur at a circumference of $M_i\lambda$: an approximation that is relatively accurate when the circumference of the pattern formed by the terminals 14 is substantially less than $\lambda$ and the antenna arms 12 correspond to tightly wound spirals. Since such an approximation or assumption facilitates comprehension of the present invention, and those skilled in the art are aware of theoretical and empirical techniques for determining the actual position of the relevant radiation regions, this convention or simplification is utilized hereinafter. Thus, with respect to a conventional six-element spiral antenna similar in construction to the antenna 10 of FIG. 1, but not including the choke elements 18, the five possible excitation modes are capable of causing sum mode (mode $M=1$) and first through fourth difference mode (modes $M=2,3,4,5$, respectively) radiation patterns of right-hand polarization sense wherein the mean circumferences of the active regions of the five operating modes are considered to be approximately $\lambda$, $2\lambda$, $3\lambda$, $4\lambda$, $5\lambda$.

To configure antenna 10 of FIG. 1 for providing the precise sum and difference mode radiation patterns of both circular polarization senses that are required by arrangements such as amplitude monopulse tracking and angle of arrival systems, the choke elements 18 of each antenna arm 12-1 through 12-6 are dimensioned and positioned such that the effective electrical radius of antenna 10 is relatively invariant over a selected frequency range and of a value which enables the antenna 10 to emit radiation in a normal manner when the antenna is excited for operation at mode orders 1 and 2 while substantially eliminating normal radiation when the antenna excited for operation at mode orders 4 and 5. More specifically, if the desired operating range extends from a lowermost frequency $f_a$ to an uppermost frequency $f_b$ and the approximation that the active region of each operating mode $M_i$ is located at an antenna circumference of $M_i\lambda$ is utilized, the choke elements 18 are configured and distributed within antenna arms 12-1 through 12-6 such that the effective antenna radius is greater than $\lambda/\pi$ and less than $2\lambda/\pi$ for all signal frequencies within the range $f_a$ to $f_b$. Thus, in such a realization of the embodiment of FIG. 1, the innermost choke element 18 of each antenna arm is approximately $\lambda_b/4$ (where $\lambda_b$ is the freespace wavelength of a signal at frequency $f_b$ and is located within an annular region that is approximately bounded by concentric circles of circumference $2\lambda_b$ and $4\lambda_a$. Likewise, the outermost choke element 18 of each antenna arm is approximately $\lambda_a/4$ in length and is located within an annular region that is approximately bounded by concentric circles of circumference $2\lambda_b$ and $4\lambda_a$. As previously mentioned, radiation zones or active regions of the practical spiral antenna normally occur at a circumference less than the assumed value of $M_i\lambda$. Thus, the innermost and outermost choke elements 18 of each antenna arm 12-1 through 12-6 are generally located relatively close to the $2\lambda_b$ and $2\lambda_a$ positions, respectively. As is depicted in FIG. 1, the remaining or intermediate choke elements 18 are positioned between the innermost and outermost choke elements and exhibit physical lengths that correspond to one-fourth the wavelength of predetermined signal frequencies that lie between $f_a$ and $f_b$. As is described in more detail hereinafter, various design parameters such as choke length and the spacing between consecutive choke elements (i.e., the length of the interconnecting solid conductor regions 16) can be adjusted and controlled to optimize antenna performance. In the presently preferred embodiments of FIG. 1 for supplying sum and difference mode operation with both right-hand and left-hand circularly polarized radiation, the antenna arms 12 are logarithmic (equiangular) spirals wherein the length of the solid regions 16 and choke elements 18 increase logarithmically along the outwardly directed path of the antenna arms. Additionally, antenna arms 12-1 through 12-6 are identical both in overall length and in the positioning and dimensioning of the choke elements 18. Thus, such a realization of antenna 10 forms a geometric pattern wherein the choke elements 18 and solid conductive regions 16 lie in circumferentially interspersed sectors of a circle. For example, the embodiment depicted in FIG. 1, which employs 14 choke elements 18 and 14 solid conductor regions 16 in each antenna arm 12-1 through 12-6 forms a geometric pattern having 12 equiangular sectors each having 14 choke elements 18 or 14 solid conductor regions 16.

With the antenna 10 configured in the above-described manner, outwardly flowing arm currents that would normally induce radiation of mode orders M=4 and M=5 are reflected by the resonant choke elements and thus propagate inwardly toward the center of antenna 10. Since little signal attenuation is experienced prior to reflection and a resonant choke element 18 provides a good approximation to an open circuit, the reflected signal currents flowing in antenna arms 12-1 through 12-6 are substantially identical to the currents that would be produced in a conventional spiral antenna having a radius corresponding to the effective electrical radius of antenna 10 wherein the excitation currents are supplied to the outer terminal of the antenna arms. As previously described, such inwardly directed arm currents cause radiation of opposite polarization sense relative to the radiation resulting from outwardly arm currents with the order of such converted mode operation being equal to $N-M_i$. Thus, with the counterclockwise spiral configuration of FIG. 1, components of excitation currents that would normally induce right-hand circularly polarized radiation at mode orders 4 and 5 are respectively reflected to cause emission of left-hand circularly polarized radiation of mode orders 2 and 1.

In view of the above description, it can be recognized that the lumped-circuit approximation of antenna 10 and each of the hereinafter described embodiments of this invention, is essentially a series of cascaded, parallel resonant circuits that are interconnected by transmission lines wherein each successive resonant circuit exhibits a somewhat lower resonant frequency and the length of the innerconnecting transmission lines increase with respect to each successive pair of resonant circuits. Moreover, because of the physical configuration of the invention and the frequencies involved, it can be recognized that fringing capacitance and other circuit effects can cause substantial electrical coupling between choke elements that are in close proximity to one another. Thus, invariancy of the effective electrical circumference of an antenna of this invention relative to frequency (i.e., the location of the effective reflection point vs. signal frequency) depends on factors such as the number of choke elements incorporated in each antenna arm, the resonant frequencies of the choke elements, the spacing between choke elements, the quality factor or Q of the choke elements, and the electrical coupling between choke elements as determined by the overall geometry of the antenna (i.e., the proximity between choke elements within different antenna arms).

Although the interdependency of several of these design parameters somewhat complicates accurate theoretical analysis of a particular embodiment and prevents the expression of simple design equations that would apply to every situation, the several available parameters impart a design flexibility that far surpasses that of prior art converted mode spiral antennas. Thus, although finalization and optimization of a particular embodiment of the invention often involves a certain amount of empirical design effort, the invention can be utilized over an extremely wide range of frequencies and adapted to numerous situations.

Figure 2A:
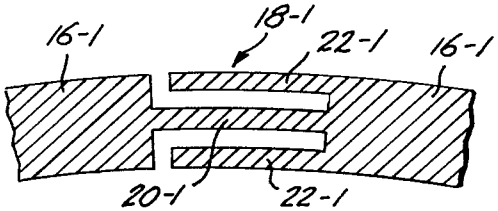
FIG. 2*a* through 2*f* depict various choke elements that can be satisfactorily employed in the practice of the invention.

The above-mentioned design flexibility that is achieved with this invention is partially affected and greatly enhanced by the fact that a variety of conductor configurations can be utilized as resonant choke elements. With reference to FIGS. 2A through 2F, wherein the excitation currents are considered to propagate from left to right along the depicted continuous conductor regions 16-1 through 16-5, the choke element 18-1 of FIG. 2A is identical to the previously described choke element 18 of the embodiment of FIG. 1 and the choke element 18-2 of FIG. 2B differs in that the outer conductive strips 22-2 innerconnect with the adjacent continuous region 16-2 that is nearestmost the center of the spiral antenna employing such a choke element. That is, the outer conductive strips 22-2 of the choke 18-2 extend outwardly toward the outer boundary of the antenna whereas the conductive strips 22-1 of the choke element 18-1 project inwardly toward the center of the antenna.

Figure 2B:
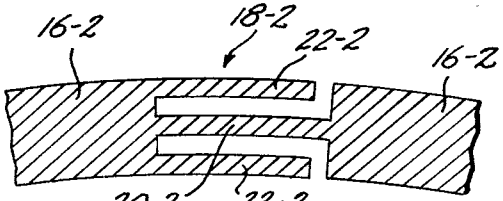

Each of the choke elements 18-3 through 18-6 (FIGS. 2C through 2F) illustrate "double" choke elements which, in general, can be arranged to exhibit a higher Q and a higher reflection coefficient (higher impedance at resonance) than the single-choke arrangements of FIGS. 2A and 2B. In this respect, choke elements 18-3 through 18-5 are, in effect, "back-to-back" single choke configurations in which the outer conductor strips 22-3 through 22-5 are innerconnected to the center conductive strips by means of conductive regions 24 that extend orthogonally outward therefrom to form a common conductive region for each of the two chokes that comprise the double-choke arrangement. In comparing the depicted choke elements 18-3 through 18-5, it can be seen that choke element 18-3 is dimensioned such that the outer conductive strips 22-3 are contained within a spiral outline formed by the solid conductive regions 16-3, whereas the choke elements 18-4 and 18-5 are configured and dimensioned such that the outer conductive strips 22-4 and 22-5 extend outwardly beyond the edges of the solid conductive regions 16-4 and 16-5. More specifically, the width of the center conductive strip 20-4 and outer conductive strips 22-4 of choke element 18-4 and the spacing therebetween are established such that the outer edges of the outer conductive strips 22-4 are positioned beyond the outer boundaries of the solid conductive strips 16-4. Choke element 18-5 of FIG. 2E illustrates a situation which, in effect, utilizes a center conductive strip identical in width to the adjacent continuous regions 16-5 so that the outer conductive strips 18-5 and associated innerconnecting conductive region 24 lie completely outside the spiral pattern defined by the continuous conductive regions 16-5.

Figure 2C:
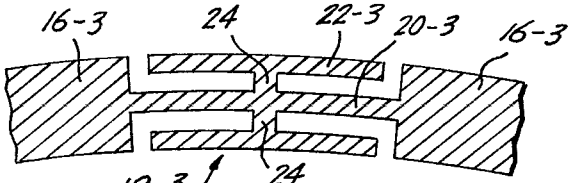
Figure 2D:
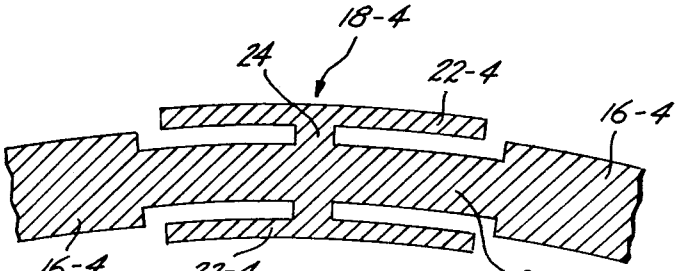
Figure 2E:
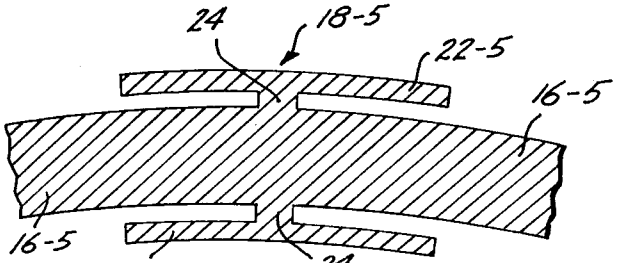

In each double-choke arrangement of FIGS. 2C through 2E, the outer conductive strips 22-3 through 22-5 can be dimensioned and arranged so that the distances between the innerconnecting conductive region 24 and the ends of the associated outer conductive strip are equal to one another and equal to $\lambda/4$ at a desired resonant frequency. On the other hand, in some situations it may be advantageous to dimension the outer conductive strips 22-3 through 22-5 so that the chokes 18-3 through 18-5 are not symmetric about a line extending through the midpoint of the innerconnecting conductor region 24. Such dimensioning in effect causes the depicted double-choke elements to correspond to mutually-coupled parallel resonant circuits that are serially connected and tuned to slightly different frequencies.

Figure 2F:
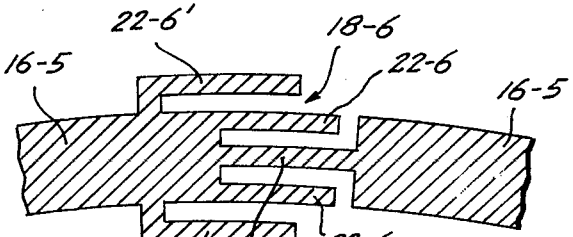

The double-choke element 18-6 depicted in FIG. 2F essentially includes an innerchoke element formed in the manner depicted in FIG. 2B and a second set of outer conductive strips 22-6′ which are spaced apart from and substantially concentric with the innermost outer conductor strips 22-6. As can be seen in FIG. 2F, the outer conductive strips 22-6' innerconnect with the associated solid conductive region 16-5 at a point that is spatially separated from the innerconnection between outer conductive strips 22-6 and solid conductive region 16-5. Like the choke configurations of FIGS. 2C through 2E, outer conductive strips 22-6 and 22-6' of choke element 18-6 can be of equal or unequal length. Further, the position at which the outer conductive strips 22-6' intersect the solid conductive region 16-5 can be established to control the degree of electrical coupling between outer conductive strips 22-6 and 22-6' hence affecting both the Q of the choke element 18-6 and the location of the effective point of signal reflection when choke element 18-6 is resonant.

Figure 3:
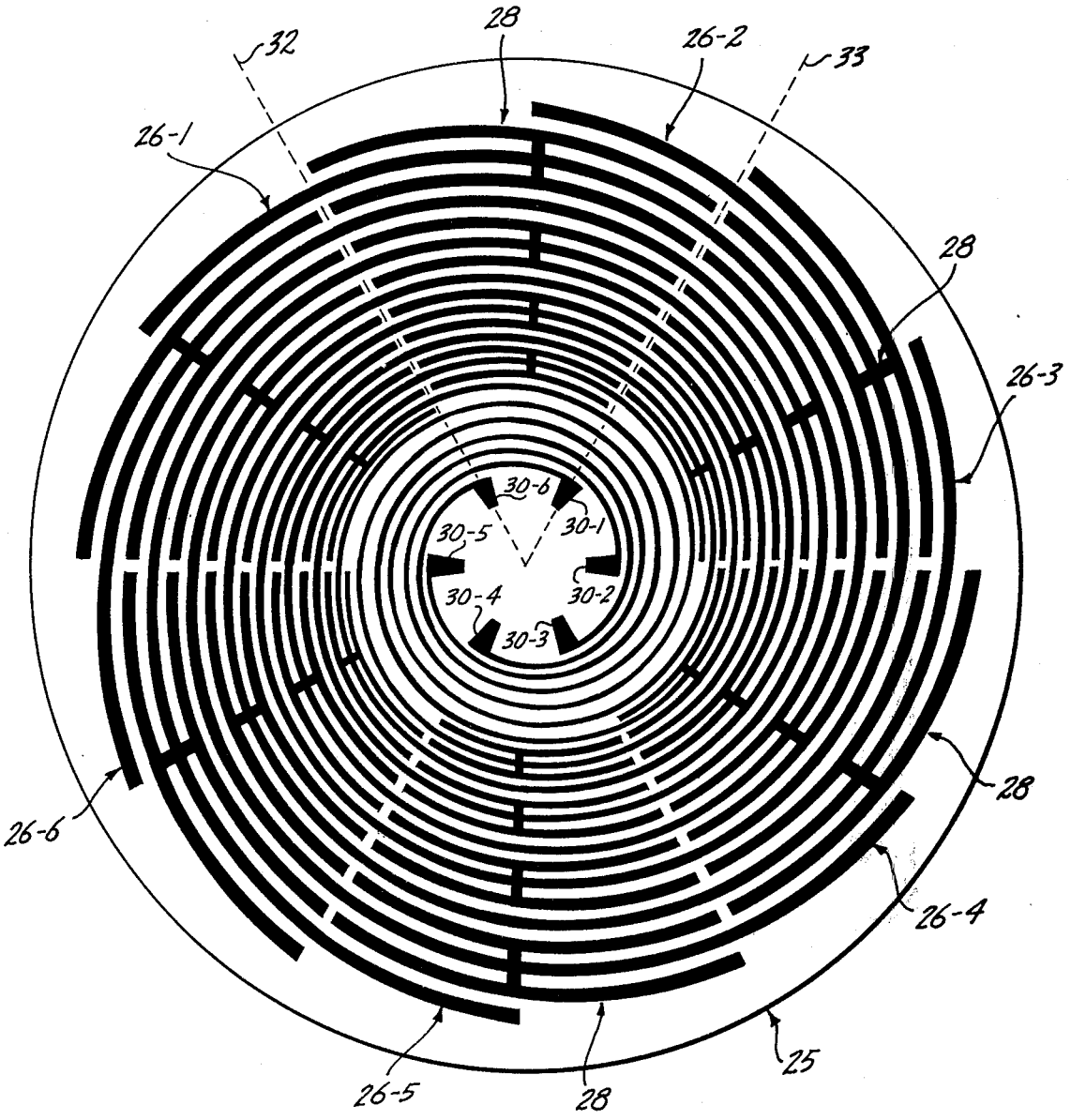
FIG. 3 depicts a second antenna embodiment configured in accordance with this invention.

Although the width of the double-choke elements 18-4 through 18-6 of FIGS. 2D through 2F is greater than the width of the adjoining solid conductor regions (16-4 through 16-6, respectively), the geometry of the antenna can be such that each antenna arm defines a relatively tight spiral. For example, FIG. 3 illustrates an embodiment of the invention (generally denoted by the numeral 25) utilizing six antenna arms 26-1 through 22-6 which include four choke elements 28 similar to choke elements 18-5 of FIG. 2E. In particular, the outer conductive strips of each choke element 28 are substantially equal in width to the center conductive strip of the associated choke element and are spaced apart therefrom by a distance substantially equal to this width dimension.

In the arrangement of FIG. 3, each of the antenna arms 26-1 through 26-6 are of identical configuration and spiral outwardly in the counterclockwise direction from associated terminal regions 30-1 through 30-6 that are circumferentially spaced apart from one another in the central portion of the antenna 25. Like antenna 10 of FIG. 1, choke elements 28 are dimensioned to resonate at frequencies within the bandwidth of interest and are positioned to provide the desired, converted mode operation. Unlike the embodiment of FIG. 1, the geometry of antenna 25 does not form 12 sectors of a circle wherein circumferentially alternate sectors include only the choke elements or only the inner connecting solid conductor regions. Rather, the geometry of antenna 25 forms six sectors wherein each sector includes four choke elements 28 radially interspersed in alteration with three solid conductor regions that interconnect choke elements within other antenna arms. For example, in order of increasing radial distance, the sector bounded by dotted lines 32 and 33 in FIG. 3 includes innermost choke element 28 of antenna arm 26-1, the second choke element of antenna arm 26-3, the third choke element 28 of antenna arm 26-5, and the fourth (outermost) choke element of antenna arm 26-1. Solid conductor regions which interconnect the first and second choke elements of antenna arm 26-2, the second and third choke elements 28 of antenna arm 26-4, and the third and fourth choke elements 28 of antenna arm 26-6, respectively, pass between the four radially spaced-apart choke elements of sector 32–33 with the spacing between the solid conductor regions and the adjacent choke elements being substantially equal to the width of the solid conductor regions and the conductive strips of the choke elements 28.

As previously mentioned, the spacing between the choke elements of each antenna arm (i.e., the length of the solid innerconnecting conductor regions) can be varied to alter the overall antenna geometry and thereby obtain a relatively invariant, electrical radius and optimal antenna performance. In this respect and depending on the relative Q of the individual choke elements, the arrangement of FIG. 1, which utilizes pairs of equal length choke elements 18 and solid innerconnecting conductor regions 16, so that each choke-conductive region pair lies within a sector of the antenna having an angle of inclusion $2\pi/N$ radians (e.g., $\pi/3$ radians or 60° in the six-arm embodiment of FIG. 1), may not provide the desired degree of signal reflection or the electrical radius of the antenna may exhibit a greater frequency dependency than is desired. More specifically, when relatively high Q choke elements are utilized and the spacing between adjacent choke elements of each antenna arm that is described relative to FIG. 1 would result in greater variation in electrical radius than that desired, it can be advantageous to decrease the length of the innerconnecting solid conductor regions to thereby increase the electrical coupling between adjacent choke elements. An example of the resulting antenna configuration for an antenna 34 having six antenna arms 36-1 through 36-6 is depicted in FIG. 4.

Figure 4:
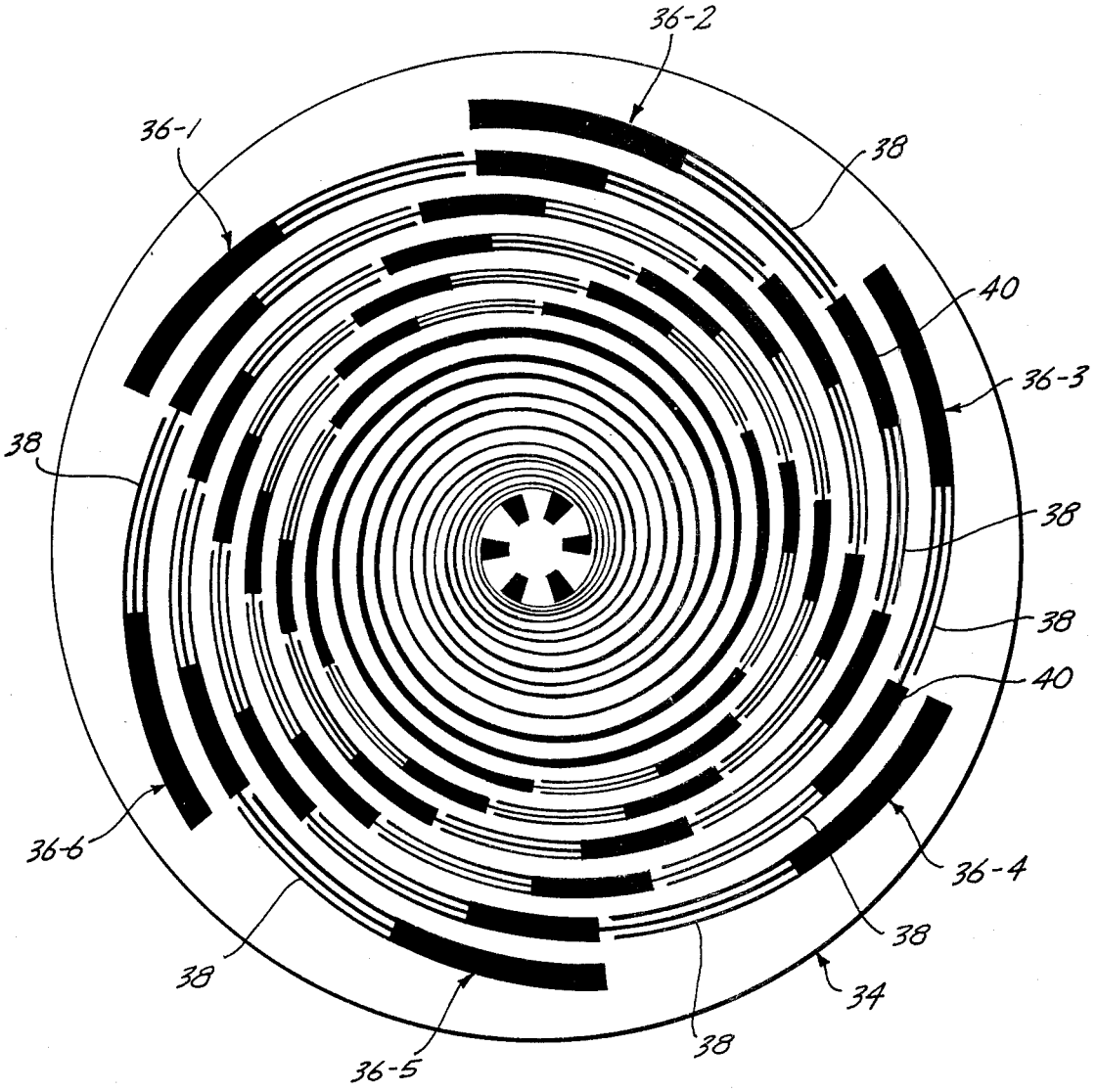
FIG. 4 depicts a third antenna embodiment configured in accordance with the invention.

In the arrangement of FIG. 4, the antenna arms 36-1 through 36-6 are identical to one another and each antenna arm includes six choke elements 38 of the type depicted in FIG. 2A. Considering each choke element 38 and the adjacent solid conductor region 40 that is integrably formed with the outer conductive strips of that particular choke element to be a choke-conductor pair or cell, it can be noted that the length of each choke element 38 is greater than the length of the associated solid conductor region 40. Further, it can be seen that the angle of inclusion which bounds each choke-solid conductor pair is less than $2\pi/N$ (less than 60° in the six-arm arrangement of FIG. 4) so that the six depicted choke elements of each antenna arm 36-1 through 36-6 lie within an arc of less than $2\pi$ radians.

In situations in which the spacing between adjacent choke elements described relative to FIG. 1 would result in a degree of signal reflection that is less than that which would be expected in view of the Q of the individual choke elements, the length of the solid interconnecting conductor regions can be increased to thereby decrease the coupling between adjacent choke elements of each antenna arm. In such an arrangement, each choke-conductive region pair (each cell), is bounded by an angle of inclusion greater than $2\pi/N$ radians.

Although the invention has been described in terms of a planar antenna configuration, those skilled in the art will recognize that the invention can be employed in a variety of situations and configurations. In this regard, FIGS. 5A, 5B and 5D illustrate conical antenna configurations that include conductive antenna arms 42 having spaced-apart choke elements 44 wherein the antenna arms 42 are supported or formed on the outer surface of a conically-shaped dielectric shell 56. In each of these arrangements, the antenna arms 42 are fed at the apex of the cone with the choke elements 44 being dimensioned and positioned in the manner described relative to the embodiments of the invention depicted in FIGS. 1 through 4. Since a conical configuration can increase the coupling between choke elements, especially those which resonate at the highest frequencies of operation and are located nearest the apex of the cone, double choke configurations, such as those depicted in FIGS.

2C through 2F, may be desirable or required to achieve optimal signal reflection.

As is indicated in FIGS. 5B and 5D, respectively, the single, conical configuration of FIG. 5A can be operated as an arrayed pair to achieve a desired radiation pattern or can be operated in conjunction with a conductive ground plane 48. Further, as is illustrated in FIG. 5C, an antenna constructed in accordance with this invention, such as the depicted planar antenna 50, can be supported above and operate in conjunction with a stepped cavity 52 that is constructed of a conductive material and dimensioned for operation over the operating range of the antenna 48.

It will be recognized by those skilled in the art that the embodiments of the invention described herein are exemplary in nature and that various modifications and variations can be made without departing from the scope and the spirit of the invention. For example, although the disclosed embodiments utilize six antenna arms and are primarily described as being configured for operation with both left-hand and right-hand circularly polarized radiation fields in the sum mode (mode order $M=1$) and the primary difference mode (mode order $M=2$), the invention can be configured to achieve various other radiation characteristics with the number of antenna arms being selected in view of the situation at hand. More specifically when configured for operation with both right-hand and left-hand circular polarization, the invention can include any integral number of antenna arms N greater than 2 with the choke elements being dimensioned and positioned to affect normal, circularly polarized radiation at one or more selected lowermost modes of the $N-1$ normal modes of operation and to reflect excitation currents that would normally cause radiation at one or more of the higher operating mode orders to produce lower mode operation with the opposite polarization sense (i.e., the reflection results in operation at a converted mode order $M_c=N-M$, where M denotes the mode order that would normally be produced). Although it can thus be recognized that at least $2K+1$ antenna arms are necessary in a situation in which the antenna is to operate with K normal modes and K converted modes, it should also be recognized that it can be advantageous to employ more than the minimal number of antenna arms. In this regard, as indicated relative to the disclosed embodiments, the choke elements are located within an annular region of the antenna that lies between the antenna region that emits radiation at the highest desired normal mode and the antenna region that would normally emit radiation that is reflected to form the desired converted modes. Thus, utilizing a number of antenna arms that is greater than the minimum number necessary, increases the area available for placement of choke elements to thereby facilitate embodiments in which optimal performance is achieved by utilizing a relatively large number of chokes.

In fact, those skilled in the art will recognize that the invention can be employed in 2-arm or single-arm spiral antennas such as those configured for sum mode operation with a single sense of circular polarization. In particular, the choke elements disclosed herein can be dimensioned and positioned within each antenna arm of such an arrangement to reflect antenna current that does not produce radiation within the associated annular active region of the antenna. As previously noted, depending on the frequency of operation and the length of the antenna arms, such currents could otherwise cause secondary radiation from more remote annular regions of the antenna to thereby deleteriously affect the antenna radiation pattern.

It should also be recognized that the choke elements depicted in FIGS. 2A through 2F can be modified in various manners and that an embodiment of the invention can include more than one choke configuration. For example, both sets of outer conductive strips of the double-choke arrangement of FIG. 2F can extend toward either the outer or inner terminus of the associated antenna arm. Alternatively, if desired or advantageous, the inner and outer set of conductive regions can extend in opposite directions. Further, it should be recognized that the antenna arms and choke elements need not be relatively thin conductive elements that are supported on a dielectric substrate. For example and with reference to FIG. 6*a*, when each antenna arm is a rectangular conductor 56, the choke element can comprise a pair of conductive plates 58 that are substantially parallel to and spaced apart from the upper and lower faces of the conductor 56. As is illustrated in FIG. 6*a*, the plates 58 are electrically interconnected with conductor 56 and are supported by conductive regions 60 that extend therebetween.

As is depicted in FIG. 6*b*, when a cylindrical or circular conductor 62 (e.g., a hollow conductive tube or wire) is utilized as the antenna arms, each choke element can be formed by a conductive cylindrical element 64 that concentrically surrounds the conductor 62. As is known in the art and depicted in FIG. 6*b*, the one end of the cylindrical element 64 of such a choke configuration is electrically interconnected with the conductor 62 by an annular conductive end plate with the opposite end of the cylindrical element 64 being spaced apart from the conductor 62 to form an annular cavity 68.

In each embodiment of the invention, dimensions such as the width of a particular choke element and the spacing between the conductive regions thereof can be established to obtain a desired characteristic impedance and quality factor Q, with a characteristic impedance that is somewhat higher than the characteristic impedance of the solid, interconnecting conductive strips seemingly producing the best results in most situations. Establishing the length of the successive choke elements of each antenna arm for resonance at successively lower signal frequencies and controlling the various other design parameters in the previously-described manner, produces antennas which provide virtually identical, normal and converted mode radiation patterns over a 100:1 or greater frequency range. Since the lower end of the operating range for an embodiment of this invention is controlled only by system restrictions on maximum antenna diameter and the upper end of an operating range is limited primarily by dimensional constraints and tolerances in forming the antenna arms and choke elements, the invention can be configured for operation over a multi-octave bandwidth both within relatively low frequency and relatively high frequency portions of the RF spectrum. For example, current state of the art circuit fabrication techniques permit the disclosed embodiments to operate at frequencies in excess of 20 gigahertz.

The invention in which an exclusive property or privilege is claimed is defined as follows:

1. A spiral antenna comprising at least one electrically conductive antenna arm, each said antenna arm extending outwardly about an axis of rotation, each said antenna arm including at least one choke element serially disposed between adjoining innermost and outermost regions of said antenna arm, each said choke element corresponding to a section of transmission line and including a central conductive region extending between said adjoining innermost and outermost regions of said antenna arm, each said choke element including at least one outer conductive region that is electrically interconnected with said central conductive region and extends in spaced-apart relationship therewith, each said choke element being dimensioned for resonance at a predetermined signal frequency and positioned along the associated antenna arm to reflect signal currents having a predetermined phase relationship relative to signal currents flowing within adjacent antenna arms.

2. The spiral antenna of claim 1 wherein each said antenna arm includes a plurality of choke elements.

3. The spiral antenna of claim 2 comprising a plurality of antenna arms spaced apart from one another and extending outwardly about said axis of rotation wherein each choke element within each said plurality of choke elements being located at substantially identical positions within an associated antenna arm to impart identical geometry to all of said antenna arms, the choke elements of each of said plurality of choke elements increasing in length relative to the distance between each particular choke element and the center of said spiral antenna.

4. The spiral antenna of claim 3 wherein the distance between each particular choke element within each antenna arm and the next outermost choke element of that same antenna arm increases relative to the distance between said particular one of said choke elements and said axis of rotation of said antenna arms.

5. The spiral antenna of claim 4 wherein said antenna arm define equiangular spirals and the length of said choke elements within each of said antenna arms and the spacing therebetween increases logarithmically.

6. The spiral antenna of claims 1, 4, or 5 wherein each said antenna arm and said central conductive region of each said choke element is formed by relatively flat conductive material with said central conductive region of each said choke element being narrower in width than said adjoining innermost and outermost regions of said antenna arm; and wherein said outer conductive region of each said choke element includes two outer conductive strips extending in spaced-apart juxtaposition with said central conductive region, the outer edges of each of said outer conductive strips lying substantially within a region defined by interconnecting the edges of said adjoining innermost and outermost regions of said antenna arm.

7. The spiral antenna of claim 6 wherein each of said two outer conductive strips and said central conductive region of each said choke element are of substantially identical width and are spaced apart by a distance substantially identical to said width.

8. The spiral antenna of claim 6 wherein said two outer conductive strips of each said choke element extend from said adjoining innermost region of said associated antenna arm and extend outwardly toward said outermost adjoining region of said associated antenna arm.

9. The spiral antenna of claim 6 wherein said two outer conductive strips of each said choke element extend from said outermost adjoining region of said associated antenna arm and extend inwardly toward said innermost adjoining region of said associated antenna arm.

10. The spiral antenna of claims 1, 4, or 5 wherein each said antenna arm and said central conductive region of each said choke element comprise a relatively flat conductive strip and wherein each of said outer conductive regions of each said choke element includes two outer conductive strips extending in spaced-apart juxtaposition with said conductive strip defining said central conductive region, each said choke element further including a transversely extending conductive region located intermediate the ends of each of said outer conductive strips for electrically connecting said outer conductive strips to said conductive strip defining said central conductive region.

11. The spiral antenna of claim 10 wherein said conductive strip defining said central conductive region of each said choke element is narrower in width than said adjoining innermost and outermost regions of said associated antenna arm and said outer conductive strips lie within the region formed by interconnecting the boundaries of said adjoining innermost and outermost regions of said antenna arm.

12. The spiral antenna of claim 10 wherein said central conductive strip of each said choke element is narrower in width than said adjoining innermost and outermost region of said associated antenna arm and said outer conductive strips project outwardly beyond the outside edges of said adjoining innermost and outermost conductive regions.

13. The spiral antenna of claim 10 wherein said central conductive strip of each said choke element is substantially identical in width to said adjoining innermost and outermost regions of said antenna arm.

14. The spiral antenna of claims 1, 4, or 5 wherein each said antenna arm and said central conductive region of each said choke element comprises a relatively flat conductive strip and wherein each said outer conductive region of said choke elements comprises two pairs of outer conductive strips, the first pair of said two pairs of outer conductive strips being interconnected with the edge boundaries of one of said adjoining innermost and outermost conductive regions of said associated antenna arm and extending in spaced-apart juxtaposition with said central conductive region, the second pair of said outer conductive strips being spaced apart from the edges of one of said adjoining innermost and outemost regions of said antenna arm and being electrically connected thereto and extending in substantially the same direction as said first pair of outer conductive strips.

15. The spiral antenna of claims 1, 4, or 5 wherein each said antenna arm is a relatively thin conductive strip and said spiral antenna further comprises a dielectric substrate for supporting and positioning each said antenna arm.

16. The spiral antenna of claims 1, 4, or 5 wherein each said antenna arm and said central conductive region of each said choke element is defined by an electrically conductive element having a substantially circular cross-sectional geometry and wherein said outer conductive region of each said choke element comprises a cylindrical conductive member and a conductive annular plate, said conductive annular plate extending between said central conductive region and one end of said cylindrical conductive member to maintain said cylindrical conductive member in a coaxial spaced-apart relationship with said central conductive region.

17. The spiral antenna of claim 16 wherein the diameter of said substantially circular conductive element defining said central conductive region of each particular choke element is substantially equally to the diameter of said substantially circular conductive element defining said adjoining innermost and outermost regions of the antenna arm including each said particular choke element.

18. The spiral antenna of claims 1, 4, or 5 wherein each said antenna arm and said central conductive region of each said choke element is of substantially rectangular cross-sectional geometry and wherein said outer conductive region of each said choke element comprises at least two outer conductive members of substantially rectangular cross-section and an electrically conductive end plate, said end plate extending outwardly from the two oppositely disposed major surfaces of said central conductive region and interconnecting with one end of each said outer conductive member to position each said outer conductive member substantially parallel to said central conductive member.

19. The spiral antenna of claim 18 wherein the major dimension of said rectangular outer conductive members and said central conductive members of each said choke element is substantially equal to the major dimension of said innermost and outermost regions adjoining that particular choke element.

20. An improved N-arm spiral antenna of the type configured for operation with both right-hand and left-hand circularly polarized radiation patterns wherein a first set of operating modes $M_n=1,2, \ldots, p$ of a first polarization sense is associated with supplying feed currents to the inner ends of the antenna arms with the phase difference between the signals induced in adjacent antenna arms being $2\pi M_n/N$ and wherein a second set of operating modes $M_c=1,2, \ldots, q$ having a polarization sense opposite to that of said first set of operating modes is associated with supplying feed currents to said inner ends of said antenna arms with the phase difference between the signals supplied to adjacent antenna arms being $2\pi(N-M_c)/N$ and reflecting the signal currents induced in said antenna arms at a point along said antenna that lies radially outward of the radiation region associated with said radiation mode $M_n=p$ and radially inward of the radiation region which would normally emit a radiation mode $N-q$ having said first sense of circular polarization, p and q being preselected non-zero integers with $p+q \leqq (N-1)$, wherein the improvement comprises choke elements for reflecting a substantial portion of said currents associated with feed currents having said phase difference of $2\pi(N-M_c)/N$, at least one of said choke elements being serially interposed between circumferentially spaced-apart inner and outer portions of each of N antenna arms, each of said choke elements comprising a first conductive strip physically and electrically interconnecting said spaced-apart inner and outer portions of an associated antenna arm, each of said choke elements further comprising at least one second conductive strip spaced apart from and extending circumferentially along at least a portion of said first conductive strip, each of said second conductive strips being physically and electrically interconnected to a single one of said inner portion of said associated antenna arm, said outer portion of said associated antenna arm and said first conductive strip.

21. The improved N-arm spiral antenna of claim 20 wherein each of said N antenna arms includes a plurality of said choke elements, the choke elements within each of said plurality of choke elements being spaced apart from one another along an associated antenna arm with each said choke element serially connecting circumferentially spaced-apart sections of said antenna arm, each successive choke element within each plurality of choke elements being of greater length dimension relative to increasing distance in the radial direction.

22. The improved N-arm antenna of claim 21 wherein each said N antenna arms are of identical geometry with the distance between successive ones of said choke elements within each particular antenna arm increasing relative to increasing distance along said particular antenna arm.

23. The improved N-arm antenna of claim 21 wherein the length of the individual choke elements within each of said antenna arms and the spacing between successive choke elements is established to form a geometric pattern in which said antenna is subdivided into 2N segments with the successive choke elements of each particular antenna arm lying within N segments of said geometric pattern that are alternately interspersed with N segments that contain the circumferentially spaced-apart sections of said antenna arm that are interconnected by said choke elements.

24. The improved N-arm antenna of claim 21 or 23 wherein said first conductive strip of each of said choke elements is narrower than said circumferentially spaced-apart sections of said antenna arm that are interconnected by said first conductive strip.

25. The improved N-arm antenna of claim 24 wherein each of said choke elements include a pair of said second conductive strips with a second conductive strip extending circumferentially in spaced-apart juxtaposition with each edge of said first conductive strip.

26. The improved N-arm antenna of claim 25 wherein each second conductive strip of said pair of second conductive strips are physically and electrically interconnected to the outer portion of said associated antenna arm that lies outwardly of that particular choke element with said second conductive strips extending inwardly toward the center of said N-arm antenna.

27. The improved N-arm antenna of claim 25 wherein each second conductive strip of said paair of conductive strips is physically and electrically interconnected to said inner portion of said associated antenna arm that lies inwardly of that particular choke element with said second conductive strips extending outwardly toward the outer terminus of said associated antenna arm.

28. The improved N-arm antenna of claim 25 wherein each of said second conductive strips of each said choke element is physically and electrically interconnected to said first conductive strip of that same choke element, said interconnection being formed by a conductive region extending between each of said second strips and said first conductive strip with said conductive region being located approximately one-half the distance between said inner and outer portions of said associated antenna arm that are interconnected by said first conductive strip.

* * * * *